US005573441A

United States Patent [19]

Smith

[11] Patent Number: 5,573,441

[45] Date of Patent: Nov. 12, 1996

[54] SECURITY POUCH WORN UNDERNEATH A BRASSIERE OR SIMILAR GARMENT

[76] Inventor: Cynthia D. Smith, 8383 Oak Hollow Dr., Pasadena, Md. 21122

[21] Appl. No.: 362,174

[22] Filed: Dec. 22, 1994

[51] Int. Cl.[6] ..... A41C 3/00

[52] U.S. Cl. ..... 450/89; 2/247; 150/134

[58] Field of Search ..... 150/134, 102; 224/901, 222, 219, 267; 450/89; 2/247, 249, 319, 321

[56] References Cited

U.S. PATENT DOCUMENTS

| | | | |
|---|---|---|---|
| D. 241,189 | 8/1976 | Clark . | |
| 2,503,847 | 4/1950 | Shanahan | 450/89 |
| 2,593,711 | 4/1952 | Weatherly | 450/89 |
| 2,624,881 | 1/1953 | Lee | 450/89 |
| 3,078,852 | 2/1963 | Stapleton | 450/89 |
| 3,322,311 | 5/1967 | Homer . | |
| 4,159,728 | 7/1979 | Kraus et al. | 383/901 |
| 4,570,688 | 2/1986 | Williams | 150/102 X |
| 4,705,086 | 11/1987 | O'Neill | 150/134 |
| 4,811,768 | 3/1989 | Williams . | |
| 4,815,510 | 3/1989 | Edelist | 150/134 |
| 5,130,899 | 7/1992 | Larkin et al. | 224/901 X |
| 5,155,869 | 10/1992 | Ralli et al. . | |
| 5,285,833 | 2/1994 | Haxby | 150/102 |
| 5,459,875 | 10/1995 | Fattorusso et al. | 450/89 X |
| 5,496,205 | 3/1996 | Lee | 450/89 |

*Primary Examiner*—Allan N. Shoap
*Assistant Examiner*—Christopher J. McDonald
*Attorney, Agent, or Firm*—David L. Marks

[57] ABSTRACT

The security pouch for holding money, credit cards, debit cards, driver's license, and other valuables. The security pouch is worn between the front center of a brassiere or similar type of clothing and the wearer's skin. The pouch is held in place by a wrap-around strap that encircles the brassiere. The pouch has a resealable opening for added security. It is made from lightweight material which can absorb perspiration and allows air to pass through the material.

2 Claims, 2 Drawing Sheets

FIG. 1
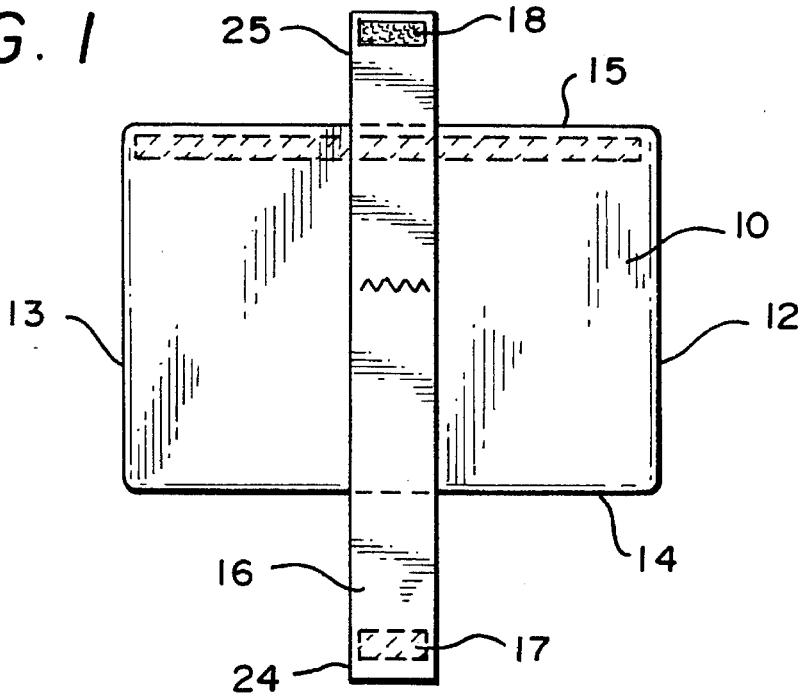
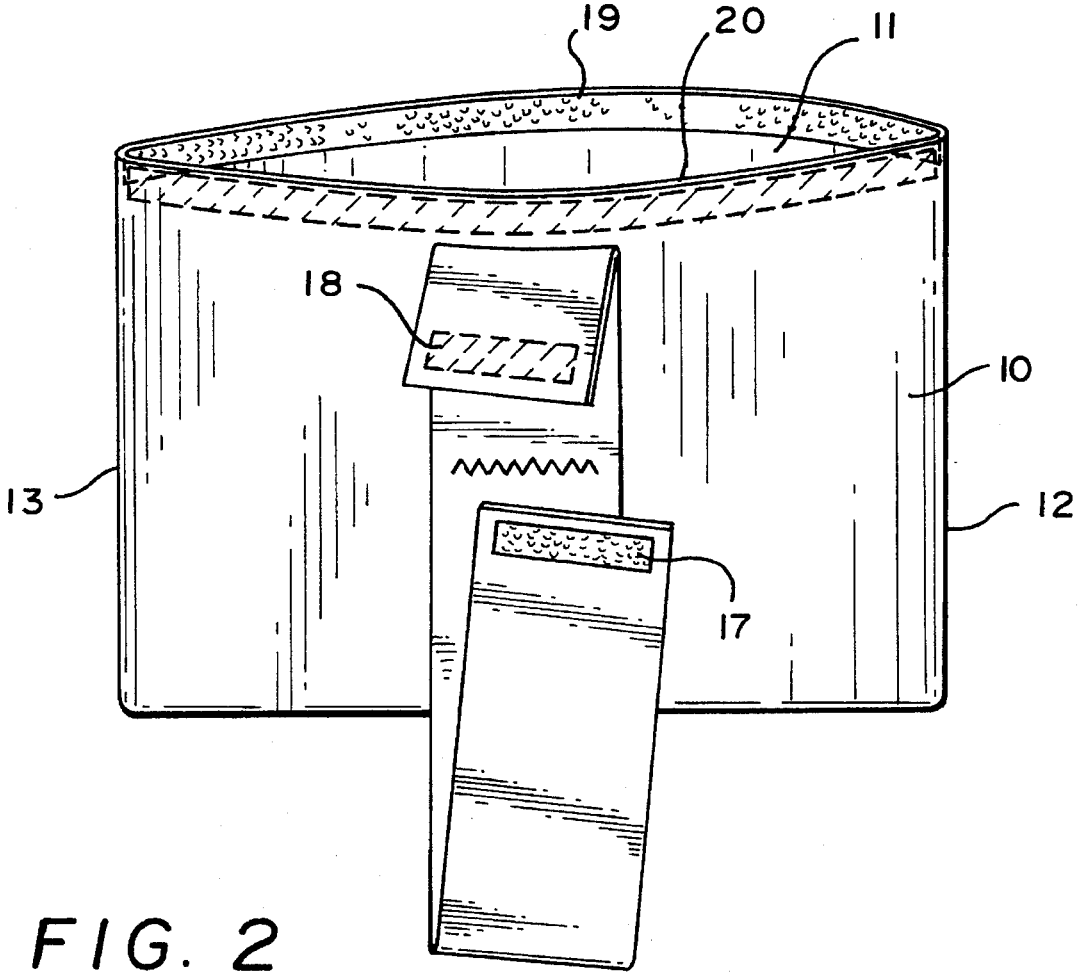
FIG. 2

SECURITY POUCH WORN UNDERNEATH A BRASSIERE OR SIMILAR GARMENT

BACKGROUND OF THE INVENTION

1. Field of the Invention

This invention relates to security pouch which holds money, credit cards, and other valuables whereby the security pouch is worn between the front center of the brassiere and the skin and held in place by a strap which encircles the front center of the brassiere.

2. Prior Art

It is common for women to carry valuables such as money, credit cards, driver's license, checks, and debit cards in a purse or similar containers. A woman usually carries these containers in her hand or wears a strap attached to the container over her shoulder. Often women carrying valuables in such containers are victims of purse snatching, muggings, or other theft. One method to prevent such crimes is for a woman to place her valuables in a security pouch which she then wears hidden from view. Various types of these security pouches exist.

One example of such a pouch is a shoulder pad that has an interior pocket into which the wearer can place valuables. This pouch is, however, is not easily accessible to the wearer because the wearer must use one hand to reach into the shoulder pad on the opposite side's shoulder. In addition, the wearer can not see the contents of the pouch and must remove the entire contents in order to obtain the desired object. It is also impossible for the wearer to discreetly remove articles from this pouch.

A second example is a security pouch which is attached to the straps of the wearer's brassiere. A woman wears this pouch underneath her blouse. The pouch lies on the woman's side underneath her arm. The wearer of this pouch has difficulty reaching and seeing into this pouch because of its position. In addition, the fold-over flap designed to keep the pouch shut makes it difficult for the wearer to open this pouch while wearing it. It is also impossible for the wearer to discreetly remove articles from this pouch. Furthermore, this pouch is made from a material which that does not absorb perspiration nor allows air to reach the wearer's skin underneath the pouch. Thus, many women would find this pouch uncomfortable to wear.

Another type of security pouch is worn around the wearer's leg. While this pouch is conveniently accessible to the wearer, it lacks a sealable top by which to keep valuables securely in place. Furthermore, it is uncomfortable to wear.

Another security pouch is a pocket with a flap which attaches it to the brassiere. This pouch lacks a sealable top to keep valuables from sliding out. It also is able to move around the brassiere, thus making it difficult for the wearer to gain access to the pouch. Furthermore, this pouch can easily fall off the brassiere.

SUMMARY OF THE INVENTION

It is an object of this invention to have a security pouch with a resealable opening at the top of the pouch for holding securely money, bank cards, credit cards, debit cards, driver's license, and other valuables.

It is also an object of this invention that the security pouch be worn in such a position that is easily accessible to the wearer.

It is another object of this invention that the security pouch is not visible to other people while being worn.

It is an object of this invention that the security pouch does not shift around while being worn.

It is another object of this invention that the security pouch be comfortable to wear. It should be lightweight. It also should absorb perspiration and allow air to pass through the material so that the user will be comfortable wearing the pouch.

In order to fulfill these objectives, this invention consists of a security pouch which is worn between the wearer's skin and the front center of the brassiere or other similar article of clothing. This pouch is held securely in place by a resealable strap. The strap is permanently attached to the pouch and can encircle the front of the brassiere or other similar article of clothing. When wrapped around the front center of the brassiere the wearer can then reversibly seal the two ends of the strap together.

Wearing the pouch between the front of the brassiere and the skin provides numerous advantages. First, it provides additional i stability so that the pouch will not slide around. Second, this position provides the wearer with easy access to the pouch. The wearer can reach down the front side of the outer garment in order to reach the security pouch and retrieve the desired contents. Third, retrieving valuables from a pouch worn in this position is less conspicuous than reaching into a security pouch worn in other places. Fourth, when worn in this position, the wearer can see the contents of the security pouch while such contents are still contained within the security pouch. Finally, when worn in this position, a potential mugger can not see the pouch or an outline of its shape.

The pouch can be made from one piece of material such that, when folded over, creates a rectangular or square shaped pouch. The material is then sewed along two open sides and the folded over side, leaving the top side open. The bottom side of the pouch can also be concave in shape; the two corners being lower than the middle of the bottom seam of the pouch. This shape can be created by sewing a semi-circular seam along the bottom side and cutting off the excess material below the seam.

In order to hold the pouch securely in place between the front center of the brassiere or similar garment and the skin, the pouch has a wrap-around strap permanently attached to one side of the pouch. The strap's non-attached loose ends can encircle the center of the brassiere. The strap has a mechanism for securing one loose end of the strap to the other loose end. This securing mechanism can be a hooks and latches mechanism sewn onto opposite sides at the ends of the strap or a button and a button-hole mechanism.

The pouch has a resealable opening so that the enclosed valuables do not fall out. As such, a resealable material such as opposable hooks and latches are sewn along the top, inside seam of the pouch. A zipper mechanism can replace the opposable hooks and latches mechanism along the top, open side of the pouch. With either mechanism the wearer can open and close the pouch as many times as desired and still have a tightly sealed container.

In order to absorb perspiration and allow air to pass through the pouch, the pouch can be made from a material consisting of cotton or a blend of cotton and other materials. These materials are lightweight and can absorb the wearer's perspiration, thus being comfortable to wear. In addition they are strong enough to hold the contents of the pouch without ripping or tearing.

BRIEF DESCRIPTION OF THE DRAWINGS

FIG. 1 shows a frontal view of a flat-bottomed security pouch with the wrap-around strap fully opened.

FIG. 2 is a perspective view of a flat-bottomed security pouch with the wrap-around strap partially opened.

DESCRIPTION OF THE PREFERRED EMBODIMENT(S)

Figure 3:
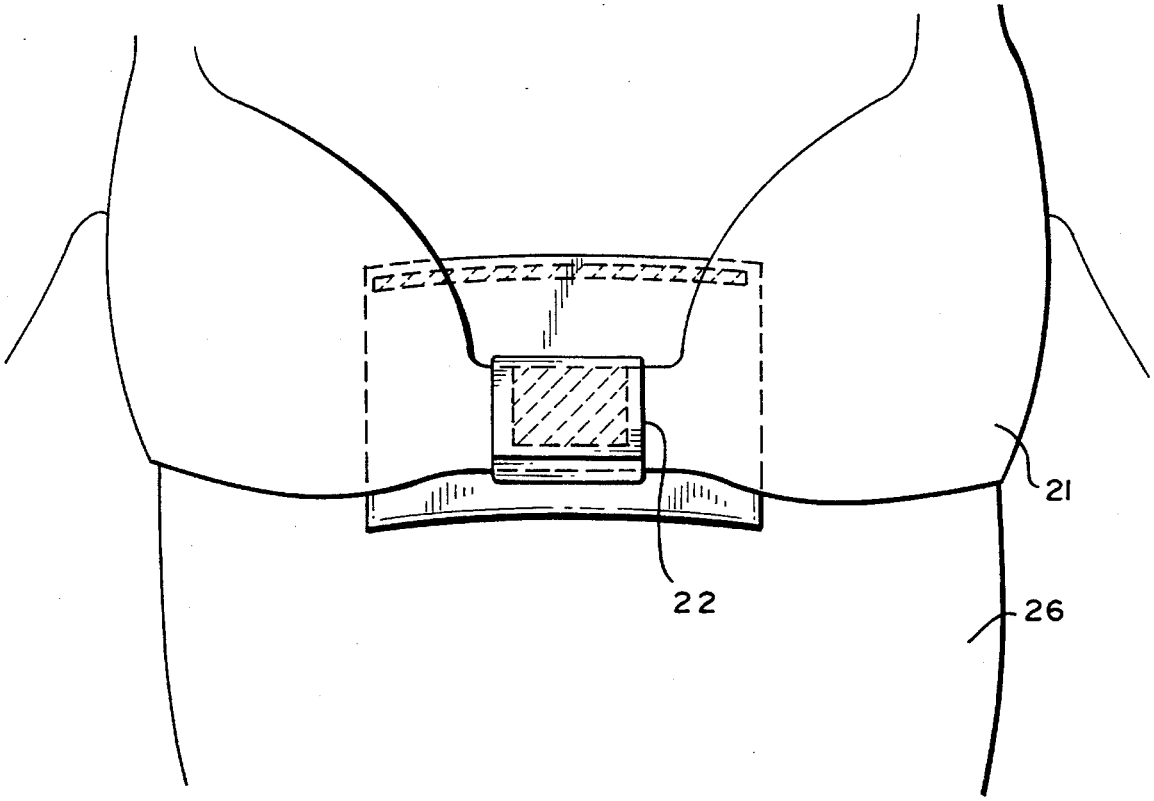
FIG. 3 shows a flat-bottomed security pouch wore by a person with the pouch between the front center of the brassiere and the wearer's skin with the wrap-around strap encircling the front of the brassiere.

This invention will now be further described by reference to the drawings. FIG. 1 shows a security pouch with a flat bottom 14. In FIG. 2, the security pouch contains a front panel 10 and a rear panel 11. The front and rear panels 10 and 11 are permanently secured together at the left and right edges 13 and 12. The panels 10 and 11 can be made from a single sheet of material. The material can be made from cotton or other material which absorbs perspiration and allows air to pass through it.

FIG. 1 shows the wrap-around strap 16 which is attached to the front panel 10 of the security pouch. Stitching is used to permanently attach the wrap-around strap 16 although other permanent attachment methods or resealable attachment methods could be used. The wrap-around strap 16 has hook-type and loop-type fasteners 17 and 18 permanently attached at the ends of the strap 24 and 25. The hook-type and loop-type fasteners are on opposite sides of the wrap-around strap 16. FIGS. 3 shows that when the strap is wrapped around a brassiere, the hook-type and loop-type fasteners 17 and 18 are facing each other so that they can attach to each other 22. Although hook-type and loop-type fasteners are used, other types of resealable fasteners can be used.

In FIG. 1 the top edge 15 of the security pouch is capable of being opened or shut so that the wearer can place things inside the pouch. As shown in FIG. 2, hook-type and loop-type fasteners 19 and 20 are sewn to the inside of the front and rear panels 10 and 11 so that the pouch may be sealed and opened. Other types of resealable material may be used, such as zippers or buttons.

FIG. 3 shows the pouch worn between a brassiere 21 and the wearer's skin 26. The wrap-around strap 22 is looped around the brassiere 21 so that the resealable fasteners are between the brassiere 21 and outer garments. The pouch is held in place by the wrap-around strap 22 and by the pressure of the brassiere pushing against the wearer's skin. The wearer can adjust the position of the pouch to fit comfortably between the brassiere and the wearer's skin.

Figure 4:
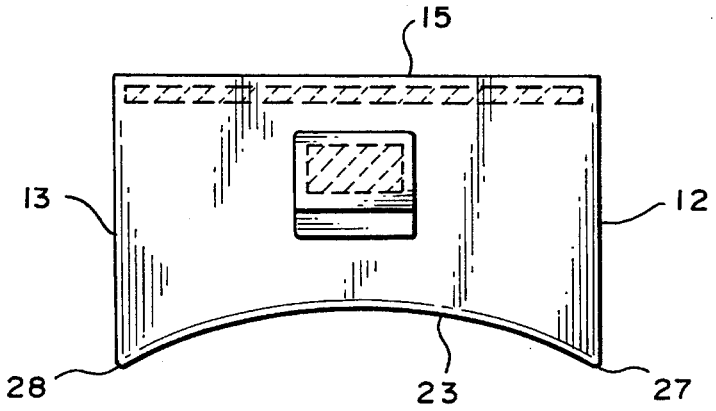
FIG. 4 shows a security pouch with a curved bottom and the wrap-around strap closed.

FIG. 4 shows a security pouch with the bottom seam 23 of the pouch cut to form a semi-circle. The two bottom corners 27 and 28 are the lowest points of the bottom seam 23. The bottom seam 23 curves upward, parabolically, from one bottom corner to the mid-point along the bottom seam, then curves back down to the other bottom corner.

While this invention has been described in its preferred embodiment, it is to appreciated that variations therefrom may be made without departing from the true scope and spirit of the invention.

The inventor now claims:

1. In combination, a brassiere and detachable pouch comprising;

a brassiere having a pair of cups, straps attached to said cups and a center piece extending between and connecting the cups, a pouch having a front wall sued back wall, each of said walls having a bottom edge, top edge and a pair of side edges, a closure along the top edges of the walls, a strap having opposed ends and opposed side edges, said attached intermediate said ends to the back wall, said side edges being substantially parallel to the side edges of the walls, mating fasteners attached to the ends of the strap, the strap encircling the center piece of the brassiere and secured thereto by the mating of the fasteners.

2. The combination of claim 1, wherein the bottom edges of the walls are arcuate.

* * * * *